US005891602A

United States Patent [19]

Neumann

[11] Patent Number: 5,891,602

[45] Date of Patent: Apr. 6, 1999

[54] DYE DONOR BINDER FOR LASER-INDUCED THERMAL DYE TRANSFER

[75] Inventor: Stephen Michael Neumann, Rochester, N.Y.

[73] Assignee: Eastman Kodak Company, Rochester, N.Y.

[21] Appl. No.: 890,456

[22] Filed: May 29, 1992

[51] Int. Cl.[6] ..... B41M 5/035

[52] U.S. Cl. ..... 430/200; 430/201; 430/270.1; 430/945; 503/227

[58] Field of Search ..... 503/227; 430/200, 430/201, 27, 495, 270.1

[56] References Cited

U.S. PATENT DOCUMENTS

| | | | |
|---|---|---|---|
| 4,412,231 | 10/1983 | Namba et al. | 430/945 |
| 4,499,165 | 2/1985 | Molaire | 430/270 |
| 4,584,258 | 4/1986 | Detty et al. | 430/270 |
| 4,626,361 | 12/1986 | Molaire | 430/270 |
| 4,783,393 | 11/1988 | Brazas, Jr. et al. | 430/270 |
| 4,891,305 | 1/1990 | Cba et al. | 430/945 |
| 5,036,040 | 7/1991 | Chapman et al. | 430/201 |
| 5,048,538 | 9/1991 | Mochizuki et al. | 428/913 |
| 5,114,904 | 5/1992 | Kawakami et al. | 428/913 |

*Primary Examiner*—Martin Angebranndt
*Attorney, Agent, or Firm*—Harold E. Cole

[57] ABSTRACT

This invention relates to a dye donor element for laser-induced thermal dye transfer comprising a support having thereon a dye layer comprising an image dye in a binder and an infrared absorbing dye associated therewith, and wherein said binder comprises a nonpolymeric, organic material with a glassy state having a glass transition temperature of greater than 25° C., capable of forming an amorphous glass with said image dye.

12 Claims, No Drawings

DYE DONOR BINDER FOR LASER-INDUCED THERMAL DYE TRANSFER

This invention relates to the use of a nonpolymeric organic material as a binder in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

A laser imaging system typically involves a donor element comprising a dye layer containing an infrared absorbing material, such as an infrared absorbing dye, and one or more image dyes in a binder.

In U.S. Pat. No. 5,017,547, there is a disclosure of typical binders for laser-induced thermal dye transfer systems. These binders are polymeric materials with cellulose acetate propionate being preferred. While such polymeric binders have been suitable for use, any increase in transferred density due to a change in the binder would be desirable.

It is an object of this invention to provide a way to increase the transferred density in a laser-induced thermal dye transfer system.

These and other objects are achieved in accordance with this invention which relates to a dye donor element for laser-induced thermal dye transfer comprising a support having thereon a dye layer comprising an image dye in a binder and an infrared absorbing dye associated therewith, and wherein said binder comprises a nonpolymeric, organic material with a glassy state having a glass transition temperature of greater than 25° C., capable of forming an amorphous glass with said image dye.

In a preferred embodiment of the invention, the nonpolymeric, organic material is derived from a mixture of at least two different compounds, each having at least two inking components joining one multivalent organic nucleus with at least two organic nuclei, wherein at least one of the multivalent organic nucleus and the organic nuclei is a multicyclic aromatic nucleus.

In another preferred embodiment of the invention, each compound has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

Examples of a linking group for $Y^1$, $Y^2$, $Y^3$ and $Y^4$ include ester, amide, imide, urethane, nitrilomethyl, eneoxy, nitrilomethyleneimino, nitrilomethylenethio, etc.

In the above formula, the expression $[(Z^1Y^2)_mR^2Y^3]_n$ describes nonpolymeric compounds which are oligomers. Oligomers are usually formed when either $Z^1$ or $R^2$ are at least bivalent. The $(Z^1Y^2)_m$ moiety describes oligomers in which $Z^1$ repeats itself such as when $Z^1$ is derived from p-hydroxybenzoic acid. When n is 1 or more, p in the structural formula is preferably 1 to avoid significant crosslinking of the compound due to the multivalent nature of $Z^1$.

The term "amorphous" means that the material is non-crystalline. That is, the material has no molecular lattice structure.

A "multicyclic aromatic nucleus" is a nucleus comprising at least two cyclic groups, one of which is aromatic, including aromatic heterocyclic ring groups. The cyclic group may be substituted with substituents such as aliphatic hydrocarbons, including cycloaliphatic hydrocarbons, other aromatic ring groups such as aryl and heterocyclic ring groups such as substituted or fused thiazole, oxazole, imide, pyrazole, triazole, oxadiazole, pyridine, pyrimidine, pyrazine, triazine, tetrazine and quinoline groups. The substituents are fused or nonfused and mono- or polycyclic. Examples of multicyclic aromatic nuclei include 9,9-bis(4-hydroxy-3,5-dichlorophenyl)fluorene; 4,4'-hexahydro-4,7-methanoindan-5-ylidenebis(2,6-dichlorophenol); 9,9-bis(4-hydroxy-3,5-dibromophenyl)fluorene; 4,4'-hexahydro-4,7-methanoindan-5-ylidenebis(2,6-dibromophenol); 3',3",5',5"-tetrabromophenolphthalein; 9,9-bis(4-aminophenyl) fluorene; phenylindandiols; 1,1'-spirobiindandiols; 1,1'-spirobiindandiamines; 2,2-spirobichromans; 7,7-dimethyl-7H-dibenzo[c,h]xanthenediol; xanthylium salt diols; 9,9-dimethylxanthene-3,6-bis(oxyacetic acids); 4,4'(3-phenyl-1-indanylidene)-diphenols and other bisphenols; 3,3'-dibromo-5',5"-dinitro-2'2"-oxaphenolphthalein; 9-phenyl-3-oxo-2,6,7-trihydroxyxanthene; and the like.

"Aliphatic hydrocarbon group" refers to monovalent or divalent, alkanes, alkenes, alkadienes and alkynes having from 1 to about 20 carbon atoms. The groups are straight or branched chain and include carbohydrate, carboxylic acid, alcohol, ether, aldehyde and ketone functions.

"Cycloaliphatic" refers to cyclic aliphatic hydrocarbon groups. The groups may be substituted with halogen, alkoxy, amide, nitro, esters and aromatic groups.

Exemplary aliphatic groups include methyl, ethyl, propyl, isopropyl, butyl, hexyl, 2-ethylhexyl, methoxyethyl, ethoxycarbonylpropyl, 3-oxobutyl, 3-thiapentyl, furfuryl, 2-thiazolylmethyl, cyclohexylmethyl, benzyl, phenethyl, phenoxyethyl, vinyl (—CH═CH—), 2-methylvinyl, allyl, allylidene, butadienyl, butenylidene, propargyl, etc.

"Aromatic" and "aromatic heterocyclic" group refers to organic groups which undergo the same type of substitution reaction as benzene. In benzene, substitution reactions are preferred over addition reactions. Such groups preferably have from 6 to about 40 nuclear atoms and are mono- and polycyclic.

Exemplary aromatic groups include quinolinyl, pyrimidinyl, pyridyl, phenyl, tolyl, xylyl, naphthyl, anthryl, triptycenyl, p-chlorophenyl, p-nitrophenyl, p-bromophenyl, 2,4-dichlorophenyl, 2-chlorophenyl, 3,5-dinitrophenyl, p-(tetrabromophthalimido)phenyl, p-(tetrachlorophthalimido)phenyl; p-(tetraphenylphthalimido)phenyl, p-naphthalimidophenyl, p-(4-nitrophthalimido)phenyl, p-phthalimidophenyl, 1-hydroxy-2-naphthyl, 3,5-dibromo-4-(4-bromobenzoyloxy)phenyl, 3,5-dibromo-4-(3,5-dinitrobenzoyloxy)phenyl; 3,5-dibromo-4-(l-naphthoyloxy)phenyl, thiazolyl, oxazolyl, imidazolyl, pyrazolyl, triazolyl, oxadiazolyl, pyrazinyl, etc. and their corresponding multivalent and fused ring configurations.

For methods of making the above organic materials, reference is made to U.S. Pat. No. 4,499,165, the disclosure of which is hereby incorporated by reference. The binder may be used at a coverage of from about 0.1 to about 5 g/m$^2$. For optimum stability of the dye-donor layer, the glass transition temperature, $T_g$, should be about 60° C. or higher.

Specific examples of the organic materials which may be used in the invention are as follows:

Composition 1

This is derived from the following reactants in a 3:1:2:6 ratio, $T_g$ 129° C.:

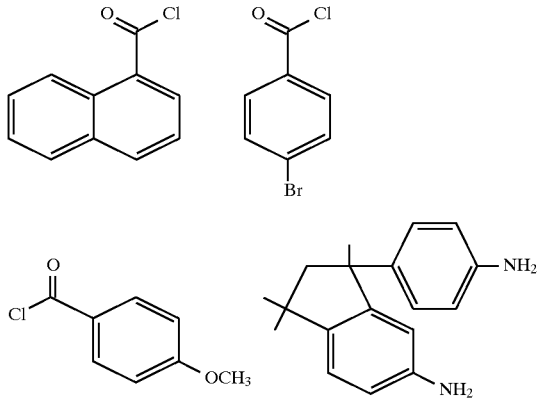

Composition 2

This is derived from the following reactants in a 7:6:7:20 ratio, $T_g$ 130° C.:

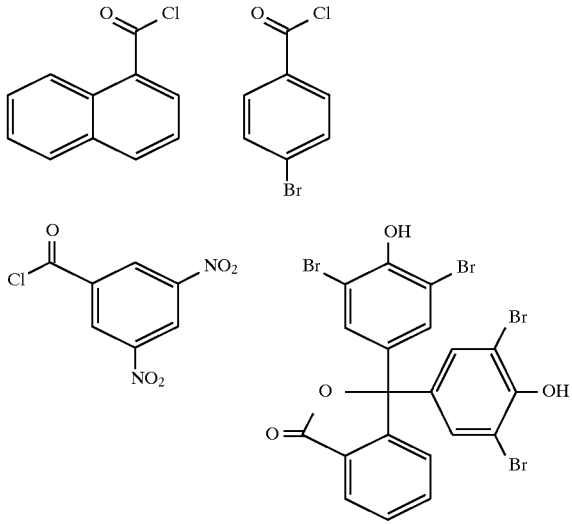

Composition 3, $T_g$ 111° C.

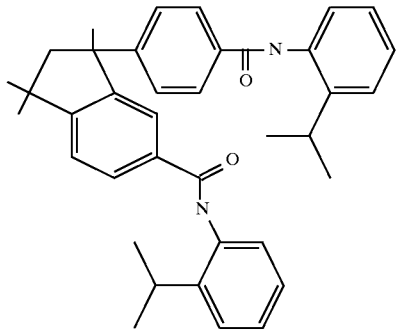

Composition 4, $T_g$ 118° C.

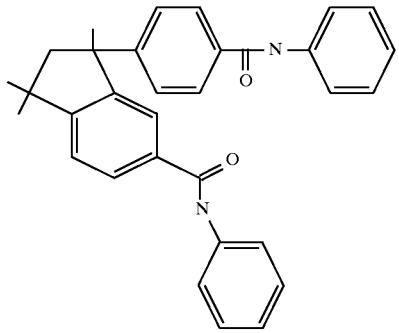

Composition 5, $T_g$ 110° C.

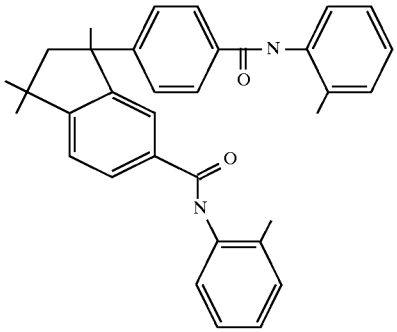

Composition 6, $T_g$ 110° C.

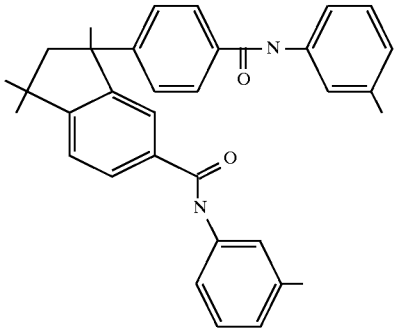

In another preferred embodiment of the invention, the infrared absorbing dye is in the dye layer.

To obtain the laser-induced thermal dye transfer image employed in the invention, a diode laser is preferably employed since it offers substantial advantages in terms of its small size, low cost, stability, reliability, ruggedness, and ease of modulation. In practice, before any laser can be used to heat a dye-donor element, the element must contain an infrared absorbing material, such as cyanine infrared absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared absorbing dye may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

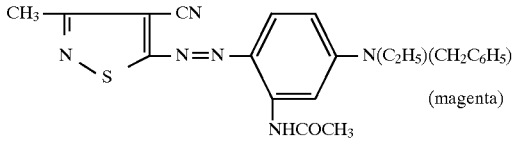

(magenta)

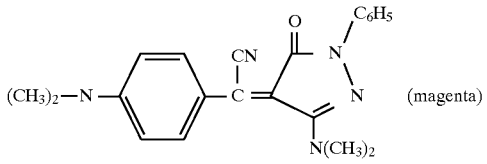

(magenta)

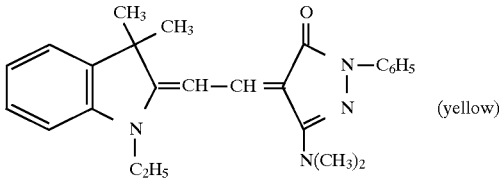

(yellow)

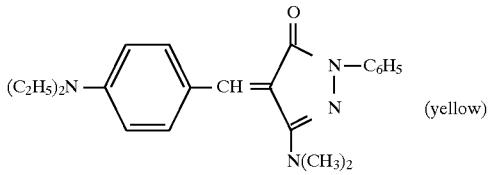

(yellow)

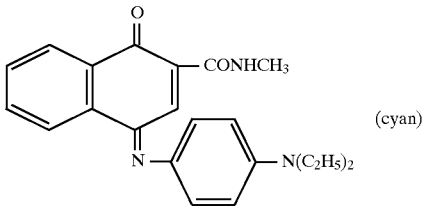

(cyan)

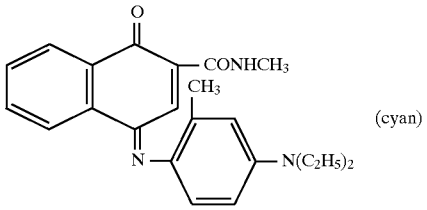

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 5 to about 200 $\mu$m. It may also be coated with a subbing layer, if desired, such as those materials described in U.S. Pat. Nos. 4,695,288 or 4,737,486.

The dye-receiving element that is used with the dye-donor element employed in the invention comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, a transparent film support is employed.

The dye image-receiving layer may comprise, for example, a polycarbonate, a polyurethane, a polyester, polyvinyl chloride, poly(styrene-co-acrylonitrile), poly (caprolactone) or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer in a binder as described above having an infrared absorbing material associated therewith, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image.

The following example is provided to illustrate the invention.

EXAMPLE

A dye-donor element was prepared by coating the following dye layer on a 100 $\mu$m unsubbed poly(ethylene terephthalate) support:

a cyan dye layer of the two cyan dyes illustrated above (each at 0.39 g/m$^2$), the cyanine infrared absorbing dye illustrated below (0.13 g/m$^2$), and the monomeric glass binder identified in the Table (0.39 g/m$^2$) coated from a dichloromethane and 1,1,2-trichloroethane solvent mixture.

A control dye-donor element was prepared as described above except that the binder was cellulose acetate propionate (2.5% acetyl, 46% propionyl).

Each of the above dye-donor elements was overcoated with a spacer layer of crosslinked poly(styrene-co-divinylbenzene) beads (90:10 ratio) (8$\mu$ average particle diameter) (0.047 g/m$^2$) and 10G surfactant (a reaction product of nonylphenol and glycidol) (Olin Corp.) (0.006 g/m$^2$) in a binder of Woodlok® 40-0212 white glue (a water based emulsion polymer of vinyl acetate) (National Starch Co.) (0.047 g/m$^2$).

IR Absorbing Cyanine Dye

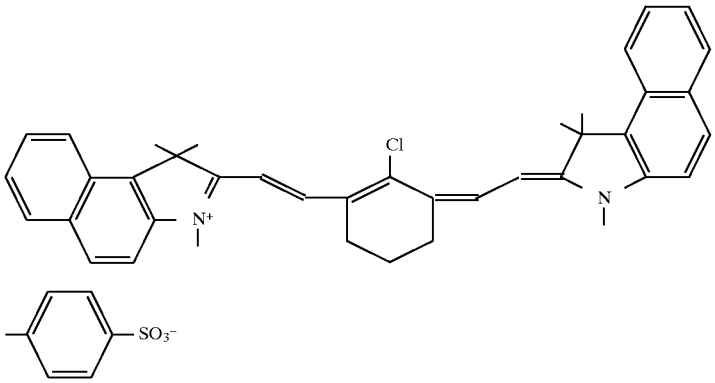

Dye-receiving elements were prepared from flat samples (1.5 mm thick) of Ektar DA003 (Eastman Kodak), a mixture of bisphenol A polycarbonate and poly (1,4-cyclohexylene dimethylene terephthalate) (50:50 mole ratio).

Cyan dye images were produced as described below by printing the cyan dye-donor sheets onto the dye receiver using a laser imaging device similar to the one described in U.S. Ser. No. 457,595 of Sarraf et al, filed Dec. 27, 1989, entitled "Thermal Slide Laser Printer". The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage whose position was controlled by a lead screw which determined the y axis position of the image. The dye-receiver was held tightly to the platen by means of the vacuum grooves, and each dye-donor element was held tightly to the dye-receiver by a second vacuum groove.

The laser beam had a wavelength of 830 nm and a power output of 37 mwatts at the platen. The measured spot size of the laser beam was an oval of nominally 12 by 13 microns (with the long dimension in the direction of the laser beam sweep). The center-to-center line distance was 10 microns and the scan rate was 525 mm/sec.

The test image consisted of a series of 7 mm wide steps of varying dye density produced by modulating the current to the laser from full power to 45.3% power in 13.6% increments.

The imaging electronics were activated and the modulated laser beam scanned the dye-donor to transfer dye to the dye-receiver. The step density image was formed by printing the cyan image. After imaging, the dye-receiver was removed from the platen and the image dyes were fused into the receiving polymer layer by radiant heating.

The Status A Red transmission density of each step-image at 100% power (maximum density) and 73% power was read as follows:

| | Status A Red Density | |
|---|---|---|
| Binder in Donor | At 73% Power | At 100% Power |
| Cellulose acetate propionate (control) | 0.98 | 1.6 |
| Glass composition 1 | 1.4 | 2.0 |
| Glass composition 2 | 1.7 | 2.1 |
| Glass composition 3 | 1.5 | 1.9 |
| Glass composition 4, 5 and 6* | 1.4 | 1.7 |

*Each material was coated at 0.13 g/m$^2$.

The data above show that the monomeric glass binder compositions provided improved transferred red dye density over that obtained by the cellulose acetate propionate control binder.

The invention has been described in detail with particular reference to preferred embodiments thereof, but it will be understood that variations and modifications can be effected within the spirit and scope of the invention.

What is claimed is:

1. In a dye donor element for laser-induced thermal dye transfer comprising a support having thereon a dye layer comprising a sublimable image dye in a binder, said image dye being capable of transferring to a dye-receiving element, and an infrared absorbing dye associated with said dye layer and which absorbs the laser radiation, the improvement wherein said binder comprises a nonpolymeric, organic material with a glassy state having a glass transition temperature of greater than 25° C., capable of forming an amorphous glass with said image dye.

2. The element of claim 1 wherein said nonpolymeric, organic material is derived from a mixture of at least two different compounds, each having at least two linking components joining one multivalent organic nucleus with at least two organic nuclei, wherein at least one of the multivalent organic nucleus and the organic nuclei is a multicyclic aromatic nucleus.

3. The element of claim 2 wherein each compound has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

4. The element of claim 1 wherein said infrared absorbing dye is in said dye layer.

5. In a process of forming a laser-induced thermal dye transfer image comprising:

a) contacting at least one dye-donor element comprising a support having thereon a dye layer comprising a image dye in a binder having an infrared-absorbing dye associated therewith, with a dye-receiving element comprising a support having thereon a polymeric dye image-receiving layer;

b) imagewise-heating said dye-donor element by means of a laser; and c) transferring a dye image to said dye-receiving element to form said laser-induced thermal dye transfer image, the improvement wherein said binder comprises a nonpolymeric, organic material with a glassy state having a glass transition temperature of greater than 25° C., capable of forming an amorphous glass with said image dye.

6. The process of claim 5 wherein said material is derived from a mixture of at least two different compounds, each having at least two linking components joining one multivalent organic nucleus with at least two organic nuclei, wherein at least one of the multivalent organic nucleus and the organic nuclei is a multicyclic aromatic nucleus.

7. The process of claim 6 wherein each compound has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

8. The process of claim 5 wherein said infrared absorbing dye is in said dye layer.

9. In a thermal dye transfer assemblage comprising:

(a) a dye donor element comprising a support having thereon a dye layer comprising a dye dispersed in a binder having an infrared absorbing dye associated therewith, and (b) a dye-receiving element comprising a support having thereon a dye image-receiving layer, said dye-receiving element being in superposed relationship with said dye-donor element so that said dye layer is in contact with said dye image-receiving layer, the improvement wherein said binder comprises a nonpolymeric, organic material with a glassy state having a glass transition temperature of greater than 25° C., capable of forming an amorphous glass with said image dye.

10. The assemblage of claim 9 wherein said material is derived from a mixture of at least two different compounds, each having at least two linking components joining one multivalent organic nucleus with at least two organic nuclei, wherein at least one of the multivalent organic nucleus and the organic nuclei is a multicyclic aromatic nucleus.

11. The assemblage of claim 10 wherein each compound has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

12. The assemblage of claim 9 wherein said infrared absorbing dye is in said dye layer.

* * * * *